US006675515B2

(12) United States Patent
Fallon et al.

(10) Patent No.: US 6,675,515 B2
(45) Date of Patent: Jan. 13, 2004

(54) LUMINOUS ELECTRIC SIGN

(75) Inventors: Timothy Ross Fallon, Boiling Springs, SC (US); Walter Keisler Tanner, Jr., Chesnee, SC (US)

(73) Assignee: Fallon Luminous Products, Spartanburg, SC (US)

( * ) Notice: Subject to any disclaimer, the term of this patent is extended or adjusted under 35 U.S.C. 154(b) by 102 days.

(21) Appl. No.: 09/794,167

(22) Filed: Feb. 27, 2001

(65) Prior Publication Data

US 2001/0027618 A1 Oct. 11, 2001

Related U.S. Application Data

(63) Continuation-in-part of application No. 09/299,895, filed on Apr. 27, 1999, now Pat. No. 6,192,610, which is a continuation-in-part of application No. 08/819,821, filed on Mar. 18, 1997, now abandoned, and a continuation-in-part of application No. 08/570,103, filed on Dec. 11, 1995, now abandoned, which is a continuation of application No. 08/262,007, filed on Jun. 17, 1994, now Pat. No. 5,533,286.

(51) Int. Cl.[7] ..... G09F 13/26
(52) U.S. Cl. ..... 40/545; 362/812
(58) Field of Search ..... 40/545, 564, 572; 362/812

(56) References Cited

U.S. PATENT DOCUMENTS

| | | | | | |
|---|---|---|---|---|---|
| 1,570,980 | A | | 1/1926 | Wiegand | |
| 1,814,379 | A | * | 7/1931 | Goddard | 40/545 |
| 1,872,428 | A | | 8/1932 | Drury | |
| 1,888,366 | A | * | 11/1932 | Willens | 40/545 |
| 1,901,100 | A | * | 3/1933 | Hoffritz | 40/546 |
| 1,917,956 | A | | 7/1933 | Eurley | 40/54 |
| 1,931,742 | A | * | 10/1933 | Scharringhausen | 40/546 |
| 2,092,768 | A | * | 9/1937 | Mansell | 40/545 |
| 2,095,291 | A | | 10/1937 | Schneider | 40/545 |
| 2,157,185 | A | * | 5/1939 | Nickel | 40/545 |
| 2,302,667 | A | | 11/1942 | Duncan | 40/545 |
| 2,540,271 | A | | 2/1951 | Lytton | |
| 2,556,779 | A | | 6/1951 | Ross | 40/545 |
| 3,300,885 | A | | 1/1967 | Haire | |
| 4,201,003 | A | | 5/1980 | Witt | 40/545 |
| 4,751,434 | A | * | 6/1988 | Helling et al. | 315/183 |
| 4,829,691 | A | | 5/1989 | Manjos et al. | 40/661 |
| 5,186,566 | A | | 2/1993 | Cameron | |
| 5,227,264 | A | | 7/1993 | Duval et al. | |
| 5,267,404 | A | | 12/1993 | Kizy | 40/545 |
| 5,529,173 | A | | 6/1996 | Salacuse | |
| 5,533,286 | A | | 7/1996 | Fallon et al. | 40/545 |
| 5,579,598 | A | | 12/1996 | Falon et al. | 40/545 |
| 6,192,610 | B1 | * | 2/2001 | Fallon et al. | 40/545 |

FOREIGN PATENT DOCUMENTS

| | | | | |
|---|---|---|---|---|
| GB | 403541 | | 12/1923 | |
| GB | 401064 | * | 11/1933 | 40/545 |

* cited by examiner

*Primary Examiner*—Brian K. Green
(74) *Attorney, Agent, or Firm*—Joseph T. Guy; Nexsen Pruet Jacobs & Pollard, LLC

(57) ABSTRACT

A luminous electric display unit is disclosed in which glass tubing containing inert gas such as neon is entirely or substantially enclosed within a protective housing, thereby providing protection both for the glass tubing and the public.

12 Claims, 12 Drawing Sheets

LUMINOUS ELECTRIC SIGN

CROSS REFERENCE TO RELATED APPLICATIONS

This application is a continuation-in-part of U.S. patent application Ser. No. 09/299,895, filed Apr. 27, 1999, now U.S. Pat. No. 6,192,610, which is a continuation-in-part of U.S. patent application Ser. No. 08/819,821, filed Mar. 18, 1997, now abandoned, and is a continuation-in-part of U.S. patent application Ser. No. 08/570,103, filed Dec. 11, 1995, now abandoned which is a continuation of U.S. patent application Ser. No. 08/262,007, filed Jun. 17, 1994, now U.S. Pat. No. 5,533,286.

BACKGROUND OF THE INVENTION

1. Field of the Invention

The current invention relates generally to a luminous electric display unit of the inert gas-containing tube type. More particularly this invention is directed to a luminous electric display unit wherein the tube is partially protected with a transparent trough that is visible from all sides of the sign.

2. Description of Related Art

Luminous electric signs of the inert gas-filled tube type have long been employed in commercial and business establishments to provide decoration and/or impart information. Typically, such signs are referred to as "neon signs" and may be hung or placed in various locations, such as storefront windows, to advertise a product, decorate, or provide message information.

The tubular lighting elements of the sign may be conformed into an array of desired letters, logos, symbols, or decorative shapes, as in a glass tube-bending operation, and the array is supportably attached by suitable brackets or wires to a rigid open frame, to a support backing, or in some form of housing or box.

In some situations, the housing that supports the lighting elements takes on special importance. For example, in applications such as food service, health care, schools, or any function involving children, safety is a primary consideration. When used in food service settings, the dust, foreign particles, and insects that tend to accumulate in neon signs become more than a mere nuisance—they may pose a contamination threat to food products in proximity. Luminous neon tube type signs, with their bright and varied colors, frequently draw the attention of children and can thus prove problematic because children are tempted to reach for the thin glass tubing. Moreover, governmental entities often place regulations on the use of luminous neon tube type signs in the above applications to guard against injury should the glass tubing break.

Security is another factor that retailers often consider when choosing a sign for advertising in and around their businesses. Many business owners want to maintain unobstructed sight lines to critical areas of their store or property to minimize opportunities for theft or other undesirable activity. Luminous neon tube type signs generally block the sight lines with their housing and thus are not used when unobstructed views are required.

As true of any product, manufacturing expense is always important. Housing for the components of a luminous neon tube type sign usually comes in multiple parts that must then be assembled. The additional assembly cost can add significantly to the manufacturing cost of the sign.

Various types of neon signs are known and found in the prior art. U.S. Pat. No. 1,570,980 to Wiegend, and U.S. Pat. No. 1,872,428 to Drury, show neon tube type signs where the glass tube is embedded in a groove to form the outline of a character or symbol. U.S. Pat. No. 5,267,404 to Kizy shows a neon tube type sign where the glass tube is mounted on a face plate that is in turn recessed within a rectangular housing. However, none of these signs completely cover the neon tube to protect the glass tubing from damage and to protect the public from injury. Kizy shelters the glass tube by placing the display unit within the housing, but the glass tube is still accessible from the front of the sign. U.S. Pat. No. 1,917,956 to Earley discloses a neon tube type sign where the glass tube is embedded in plaster and wax. While the plaster provides strong support for the tube, the front side of the tube is still exposed to the elements and thus may be soiled with insects, dust, and other foreign materials.

In addition, all of the above signs will block the sight lines wherever they are used and thus are not preferred where security is important.

None of the above signs use a single unit of material to totally encapsulate the glass tubing. Although Earley embeds the tubing in plaster and wax, the manufacturing process requires the plaster to be etched away in front of the tubing thus requiring a labor intensive step that defeats the benefits of complete encapsulation.

In view of the above, and in accordance with the current invention, it is desirable to provide a luminous electric display unit of the inert gas-filled tube type that protects both the glass tubing and the public from harm and keeps the glass tubing free from foreign debris. It is also desirable to provide a luminous electric display unit that is substantially transparent to allow for greater visibility of activities taking place in and around a place of business, for example. In addition, it is also desirable to reduce assembly expense by forming the housing from a single unit of material that encapsulates the glass tubing and is then sealed.

BRIEF SUMMARY OF THE INVENTION

Accordingly, one object of the current invention is to protect the lighting array of a luminous electric display unit of the inert gas-filled tube type from glass breakage and contamination by dust and foreign matter.

Another object is to protect the public from the dangers resulting from glass breakage or inappropriate handling of a luminous electric display unit.

Yet another object is to provide a luminous electric display unit that meets governmental regulations for use in food service or health care settings.

Still another object, in one form of the invention, is to provide a luminous electric display unit having a translucent housing thereby producing a substantially unobstructed view through the display unit.

An object of the current invention is to provide a luminous electric display unit wherein the illuminated tubing is visible from any angle of which the display unit is viewed.

A still further object, in one form of the invention, is to form the housing for the display unit from a single unit of material that is then molded to totally encapsulate and provide protection for the glass tubing held inside.

Also, another object of this invention is to provide a luminous electric display unit where the glass tube is not totally encapsulated and yet protected from environmental elements while remaining visible from all angles.

In accordance with another embodiment of the invention, both the face and back portions of the protective housing are made from a translucent material thereby minimizing any visual obstruction through the display unit.

In accordance with still another embodiment of the invention, the protective housing is made from a single unit of material that is then molded to encapsulate the glass tubing.

Further objects and advantages will become apparent from a consideration of the following description and drawings.

According to one aspect of the current invention, the foregoing and other objects and advantages are attained by providing a luminous electric display unit having a protective housing that comprises a back portion and a face portion. The back portion has elongated grooves that are recessed from the face portion for receiving a gas filled glass tube. The face portion holds the glass tubing in place in the elongated grooves and also protects the tubing from damage or contamination by foreign debris. Electrical circuitry located behind the back portion of the housing illuminates the tubing when the circuitry is connected to a power source.

According to another aspect of the claimed invention, the foregoing and other objects and advantages are attained by providing a luminous electric display unit having a face portion and a back portion. In this embodiment, the face portion has elongated grooves for receiving and supporting gas filled tubes. The grooves are complementary in shape to the shape of the tubes and are dimensioned such that the tubes are supported entirely within the grooves such that the tubes are protected from accidental contact. The back portion may be blank, in the case of a one-sided unit, or may also be provided with grooves and tubing to create a two-sided unit. Electrical circuitry for powering the tubes is enclosed between the face and back portions. In this embodiment, gas filled tubes may also be placed between the face and back portions to provide lighting from within the unit.

In yet another aspect of the invention, the foregoing and other objects and advantages are attained by providing a luminous electric display unit having a face portion and a back portion. Glass tubing is provided between the face and back portions and enclosed thereby to provide illumination and backlighting for the unit. Electrical circuitry is also provided between the face and back portions for powering the glass tubes. Additionally, a peripheral lip or trough formed from the back portion is provided to hold a gas filled tube around the periphery of the unit. The peripheral trough is dimensioned such that the tube therein does not protrude from the trough, thus providing protection for the tube.

DETAILED DESCRIPTION OF THE INVENTION

Figure 1:
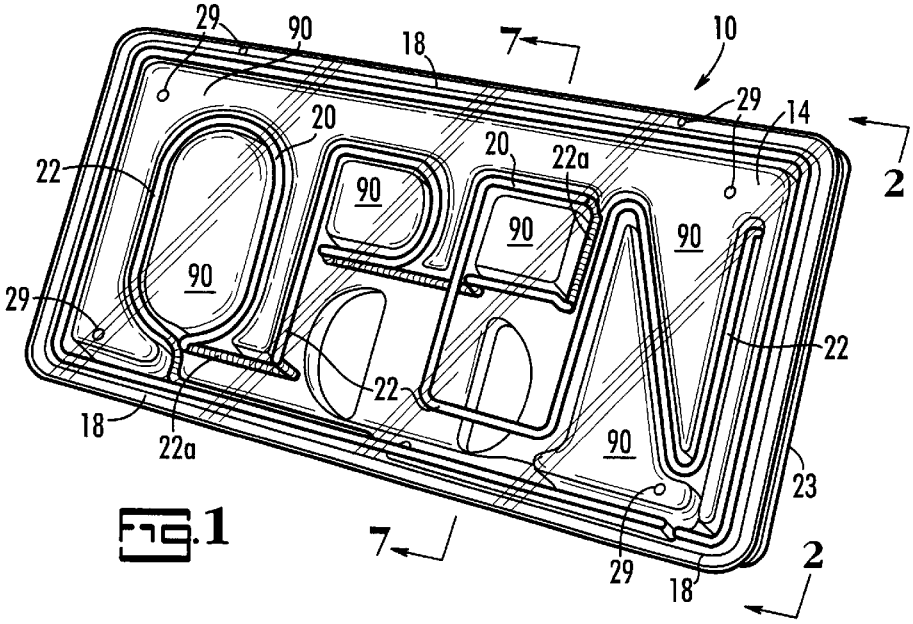
FIG. 1 is a front perspective view of a first embodiment of an electric luminous display unit of the current invention.

Referring now to the drawings, an improved luminous electric display unit that meets and achieves the various objects of the invention set forth above is shown.

As seen in FIGS. 1 through 4, electrical luminous display unit 10 includes support housing 12 having a substantially rigid face portion 14 and a substantially rigid back portion 16. Back portion 16 is preferably comprised of a thermoformable material while face portion 14 can be constructed from a less expensive material. Back portion 16 contains one or more elongated grooves 18, 20 for the receipt and protection of elongated glass tubing 22. Glass tubing 22 contains an inert gas, such as neon, that is electrically excited via transformer 28 and cables 26 to illuminate tubing 22. Tubing 22 forms the word "OPEN" surrounded by a generally rectangular border. To dissipate heat emanating from glass tubing 22 and transformer 28, back portion 16 contains vent holes 4 allowing cool air to enter the sign near the bottom and warm air to escape from the top of the sign.

Glass tubing 22 for containing the inert gas is bent, as in a heat-shaping operation. In such a shaping operation, a single length of tubing forms the entire word, e.g., OPEN, and the rectangular border. To separate and distinguish the letters, transition portions 22*a* of the length of tubing are, where practical, bent to lie primarily in a plane separate from the plane of the letters of the message to be conveyed (See FIGS. 1, 4 and 5). Transition portions 22*a* are also covered with an opaque coating to minimize the amount of light escaping from that portion of the tubing.

Figure 2:
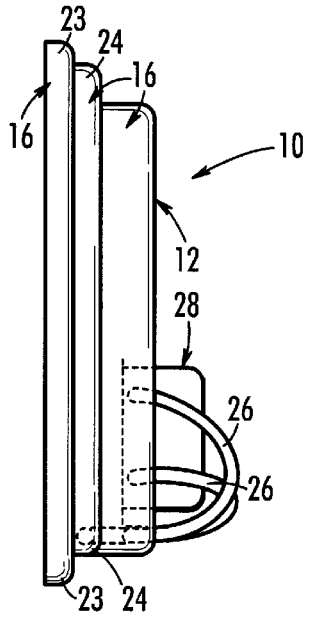
FIG. 2 is a right side elevation view of the display unit of FIG. 1 taken generally along lines II and looking in the direction of the arrows.
Figure 4:
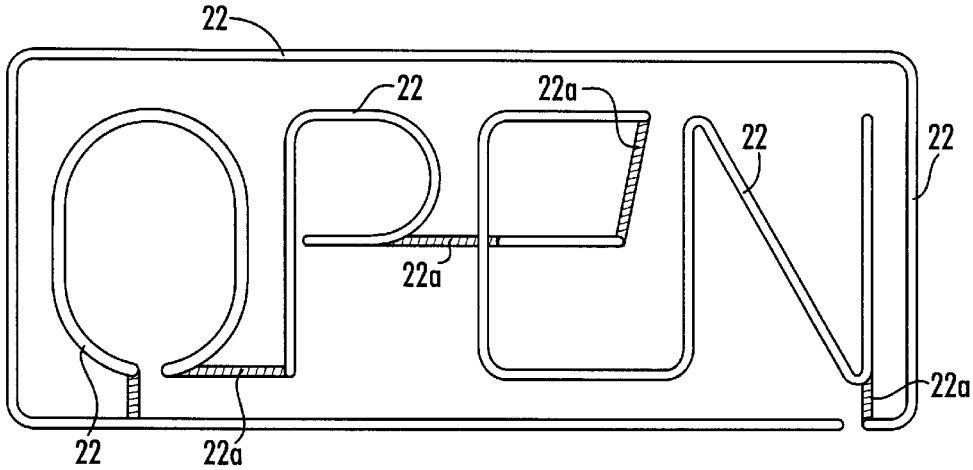
FIG. 4 is a front elevation view of the glass tubing of the luminous display unit of FIG. 1.
Figure 5:
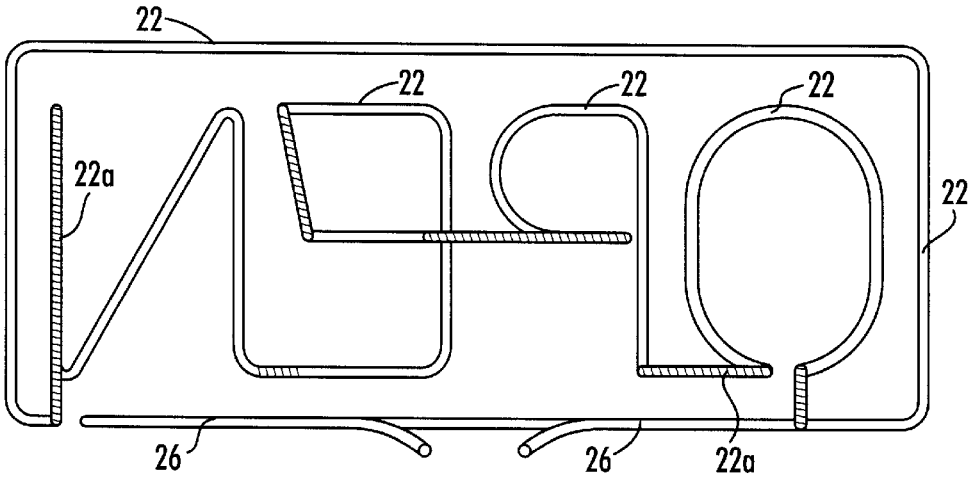
FIG. 5 is a rear elevation view of the glass tubing of the luminous display unit of FIG. 1.
Figure 6:
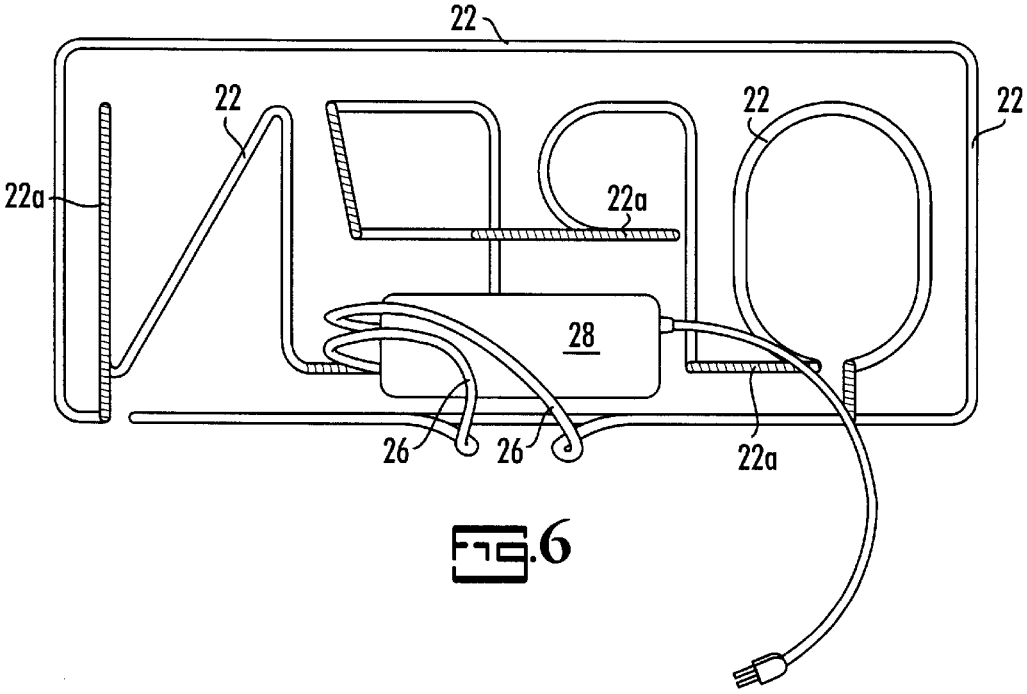
FIG. 6 is a rear elevation view of the glass tubing of the luminous display unit of FIG. 1 showing the connection of the electrical circuitry to the tubing.

As shown in FIGS. 2, 5 and 6, transformer 28 and cables 26 are used to deliver electrical power to display unit 10 from a conventional 120V AC power supply. Once energized, the gas illuminates the display unit 10 by transmitting light through the transparent portions of tubing 22. Transformer 28 is preferably positioned in an area of back portion 16 having no recessed grooves 20 (i.e., behind island 90 areas). This allows the overall width of the sign to be reduced to essentially the width of the transformer 28 plus the thickness of the materials comprising both face portion 14 and back portion 16 as shown best in FIG. 2. One clear advantage of reducing the overall sign thickness is that the sign can be hung against a wall instead of just from a ceiling. For maximum safety from electrical hazards, the transformer 28 could be encased in plastic such that the only component external to the housing 12 would be the power cord.

Figure 3:
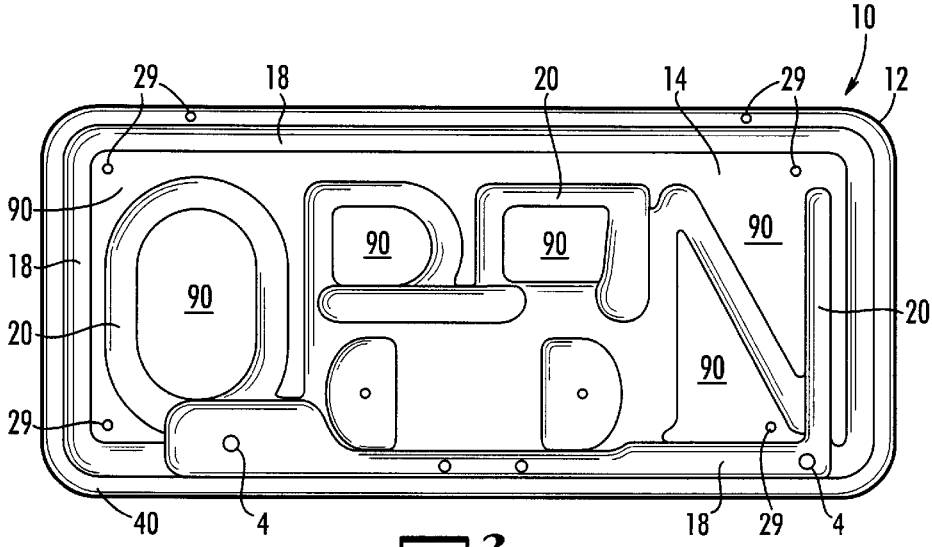
FIG. 3 is a front elevation view of the display unit of FIG. 1 with the glass tubing removed to better show the grooves in the back portion of the unit, which receive and protect the tubing.
Figure 7:
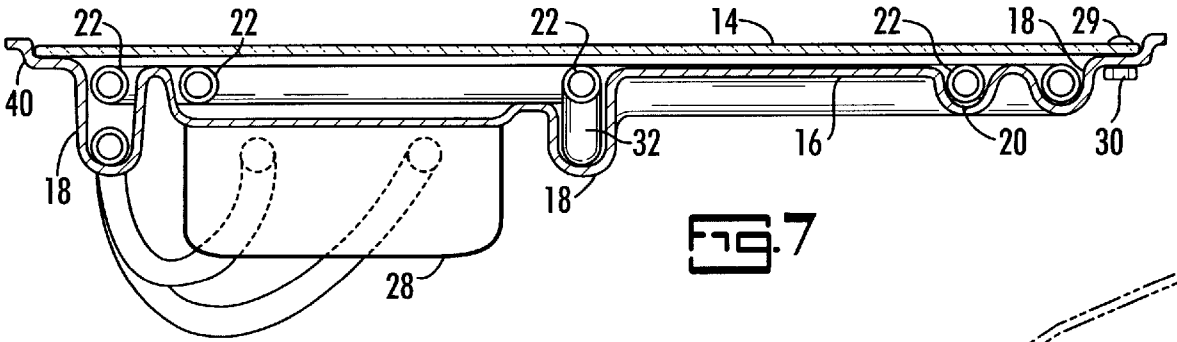
FIG. 7 is a sectional view of the display unit of FIG. 1, taken generally along lines VII—VII and looking in the direction of the arrows.

FIGS. 1, 3, and 7 show the encapsulation of glass tubing 22 within grooves 18, 20 and face portion 14. Glass tubing 22 is held in place by grooves 18, 20, face portion 14, and islands 90. Grooves 18, 20, face portion 14, and islands 90 combine to provide protection both for the tubing and the public. Rubber bushings 32 are used to position glass tubing 22 in grooves 18, 20 to ensure a tight fit. Alternative means, such as plastic clips, or sponge cushioning could be used instead of rubber bushings 32.

Figure 9:
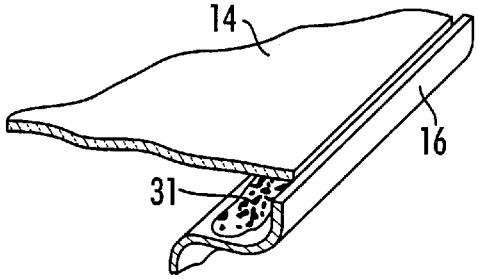
FIG. 9 is a broken-away perspective view showing one technique for affixing the face portion of the unit to the back portion.
Figure 10:
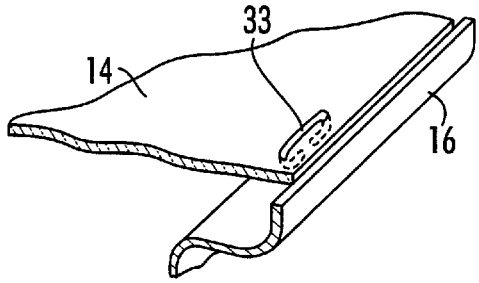
FIG. 10 is a broken-away perspective view showing a second technique for affixing the face portion of the unit to the back portion.
Figure 11:
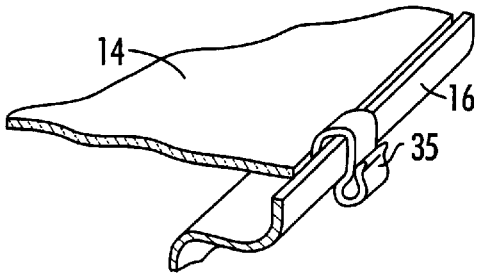
FIG. 11 is a broken-away perspective view showing a third technique for affixing the face portion of the unit to the back portion.
Figure 12:
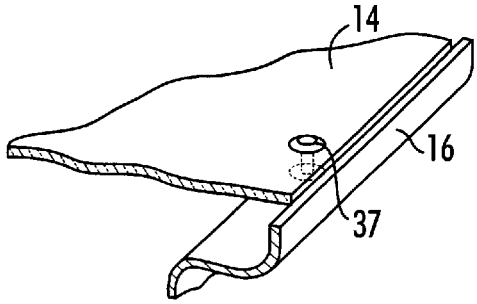
FIG. 12 is a broken-away perspective view showing a fourth technique for affixing the face portion of the unit to the back portion.
Figure 13:
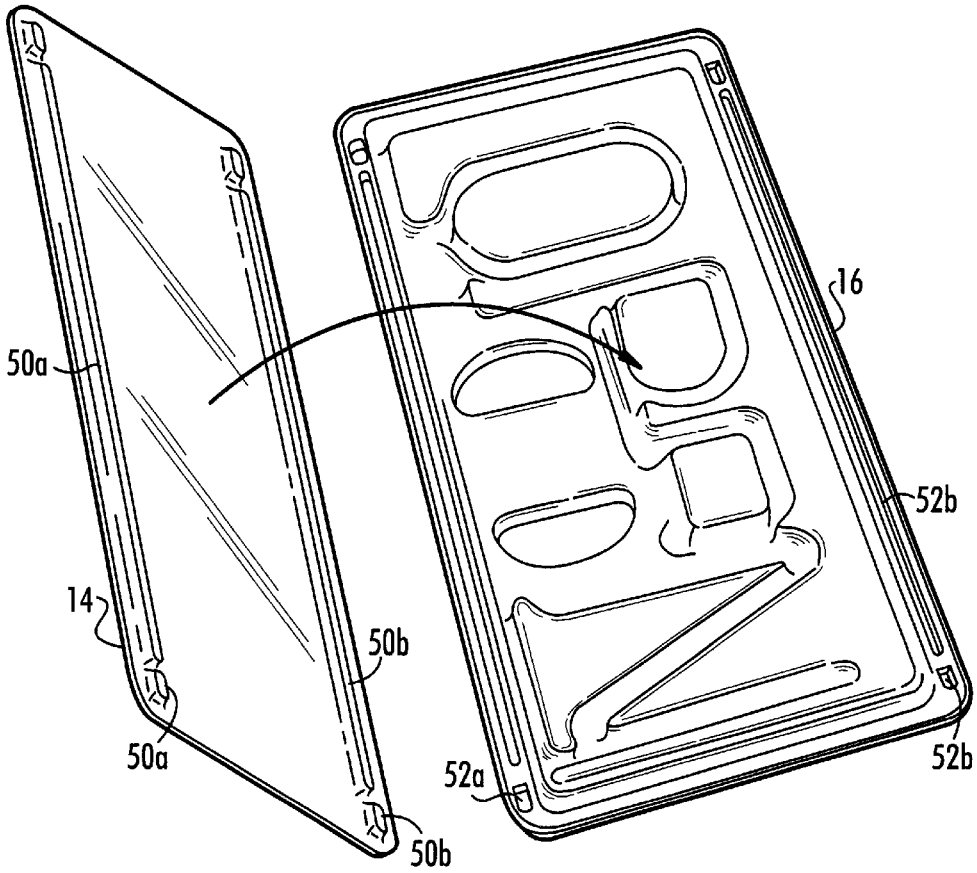
FIG. 13 is a perspective view showing a "blister pack" design for attaching the face and back portions to one another.

Face portion 14 is received into back portion 16 along lip 40 as shown in FIG. 7. Bolts 29 and nuts 30 are used to secure face portion 14 to back portion 16. In one common embodiment, face portion 14 is secured to back portion 16 via a "blister pack" seal (see FIG. 13). This technique requires raised regions 50*a,b* (i.e., blisters) that are dispersed about either face portion 14 (as shown in FIG. 13) or back portion 16 and extend towards the other portion. The portion without the blisters has corresponding apertures 52*a,b* that are designed to receive blisters 50*a,b* and thus secure the two portions together via friction. The shape and position of blisters 50*a,b* and apertures 52*a,b* can be modified to suit the shape and contents of housing 12. For example, a long narrow blister 50*a* and aperture 52*a* combination may be used along the edges of the display unit 10 while smaller, square shaped blisters 50*b* and apertures 52*b* may be used at the corners. Still another approach for attaching face portion 14 to back portion 16 involves forming lips that extend from the edges of one or both portions. When the two portions are placed together, the lips hook over an opposing edge or lip to ensure a secure fit. Other alternatives for securing face portion 14 to back portion 16 include: an adhesive (FIG. 9), staples (FIG. 10), clips (FIG. 11), screws (FIG. 12), heat melting, thermo-seal, ultrasonic welding, or other known securing means.

Face portion 14 is made from a translucent material. Back portion 16 is opaque for daylight applications and is preferably translucent for indoor, night time, or applications requiring an unobstructed view through the sign.

Figure 8:
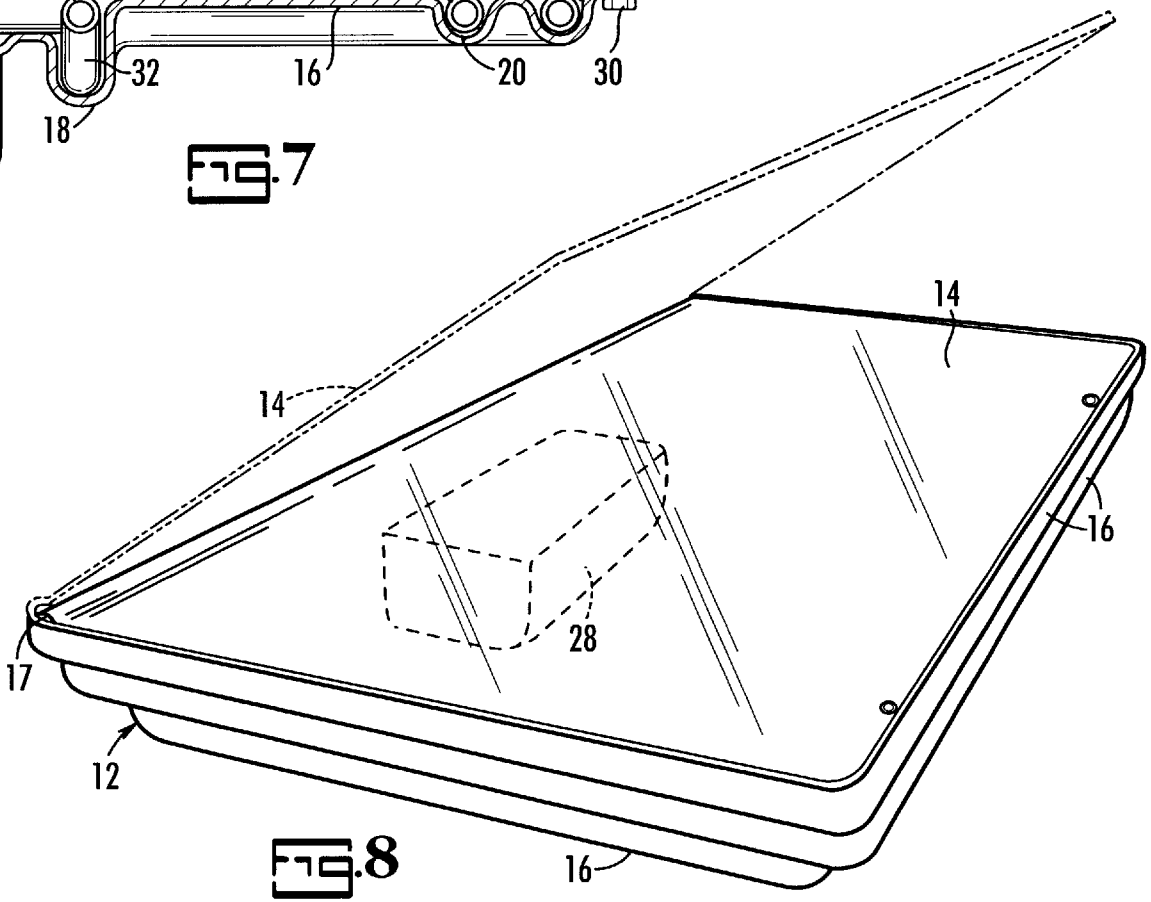
FIG. 8 is a right side perspective view of a second embodiment of the current invention showing the housing made of a single unit of material.

FIG. 8 shows yet another embodiment where a single piece of material is used to form both face portion 14 and back portion 16 of housing 12. In forming housing 12, back portion 16 should be comprised of a thermoformable material. As part of the thermoform process, a mold is impressed upon the heated material to form grooves 18, 20 in back portion 16 (see FIG. 7). As shown best in FIG. 7, grooves 18, 20 vary in depth. Deeper grooves are used to receive segments of transition portions 22*a* allowing those portions of tubing 22 to lie in a separate plane than the portions forming the letters. Face portion 14 is often comprised of a thin, pliable material that is relatively inexpensive. Since face portion 14 does not carry any load bearing responsibility, its composition and design is primarily dictated by the degree of protection required for tubing 22 and the public. Next, as shown in FIG. 8, the material is folded along flexible hinge 17 such that face portion 14 and back portion 16 oppose one another. Flexible hinge 17 is commonly a score line, but alternative embodiments are envisioned where separate hinge hardware is used to join face portion 14 to back portion 16. Face portion 14 and back portion 16 are then secured to each other using a blister pack seal 50*a,b* or any of the other means discussed above. By using a unitary piece of material to form the entire housing, manufacturing costs are reduced because fewer steps are required. For example, the housing is commonly placed on what is known in the industry as a "trim dye." Next, excess material is trimmed away to form the housing's shape and then holes and grooves are impressed upon the housing as desired. When a unitary piece of material is used to form the entire housing, these steps can be performed in one session on the dye. By contrast, multiple housing components each require their own session on the trim dye. In addition, a light weight, yet safe, display unit can be constructed by reducing the densities of face portion 14 and back portion 16 where appropriate.

Figure 14:
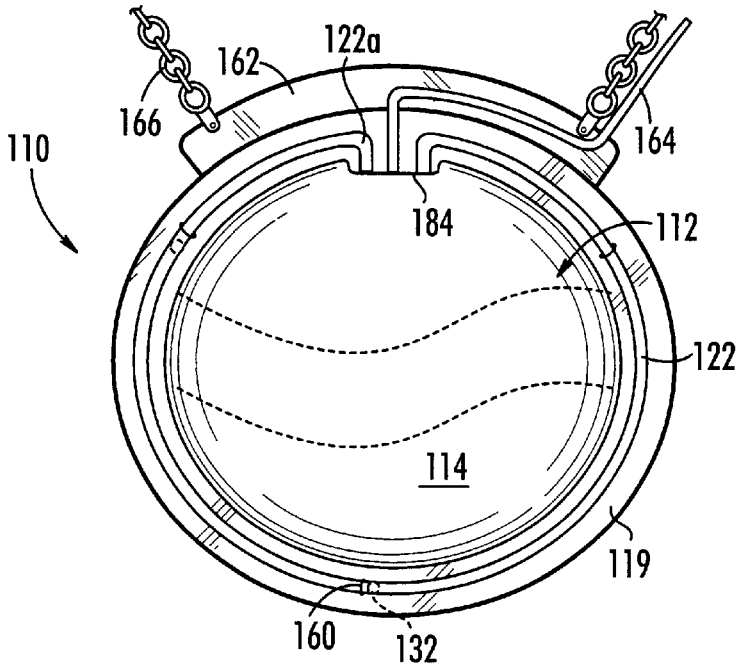
FIG. 14 is a front elevation view of a third embodiment of the electric luminous display unit.
Figure 15:
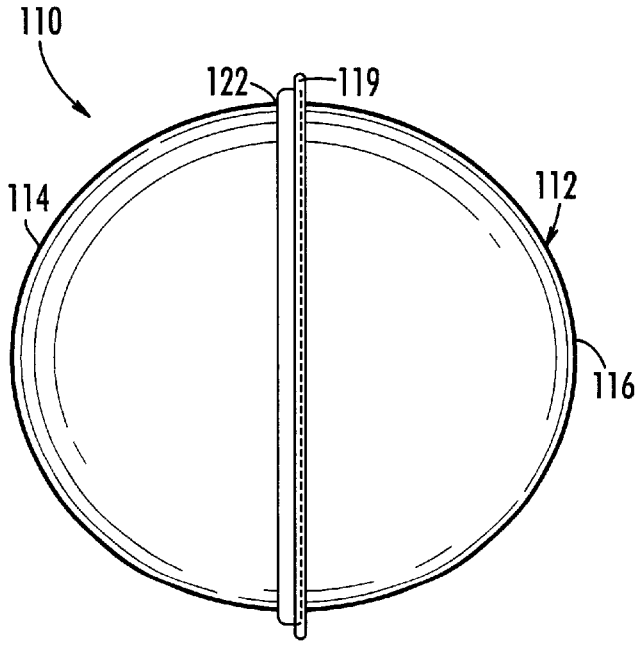
FIG. 15 is a bottom plan view thereof.
Figure 16:
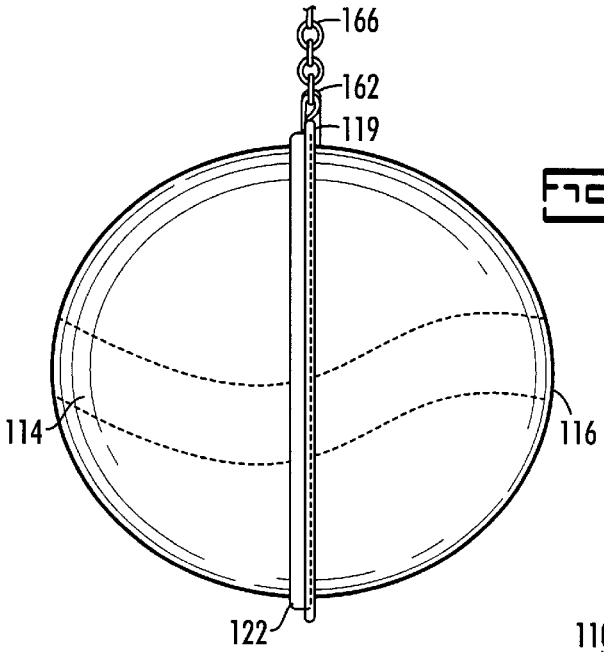
FIG. 16 is a side elevation view, the opposite side being a mirror image thereof.

FIGS. 14, 15 and 16 are directed toward the third embodiment in the electrical luminesce display unit 110. This third embodiment is comprised of a support housing 112 which has a front face portion 114 and a back portion 116. Along the perimeter of the support housing 112 is a trough 119 which holds a glass tubing 122. A glass tubing is held within the trough by a retention wire 160 and at every location of a retention wire there is also a bushing 132 placed between the glass tubing 122 and the trough 119 to prevent the glass tubing 122 from being damaged. At the top of the support housing 112 there is a hanger portion 162 formed therewith. This hanger portion 162 is integrally formed with the housing 112, either the front face portion 114 or the back portion 116. The hanger portion 162 allows the electric luminous display unit 110 to be hung from a support structure such as a ceiling or a wall. Connected to the hanger portion 162 are chains 166, or any other type of conventional hanging unit, that allow the electric luminous display unit 110 to be hung.

Figure 17:
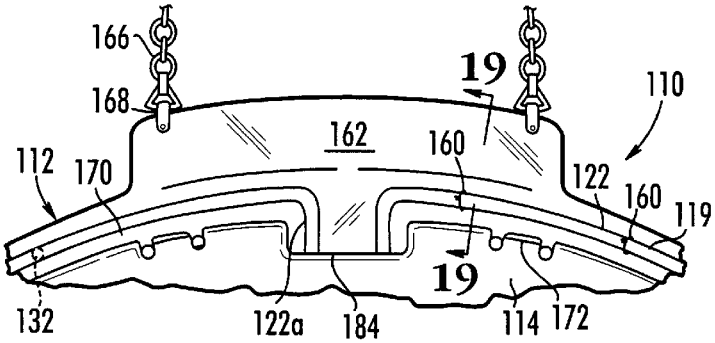
FIG. 17 is a partial blown-up front elevation view of the top portion of the electric luminous display unit.

FIG. 17 is a partial blown-up front elevation view of the top portion of the electric luminous display unit 110. In this figure, chain elements 166 are connected to connecting means 168 which are connected to the hanger portion 162 allowing the electric luminous display unit 110 to be hung from a support structure. FIG. 17 more clearly discloses the trough element 119 that holds the glass tubing 122. The glass tubing is held within the trough unit 119 by retention wire 116. Between the glass tubing 122 and the trough unit 119, a bushing 132 is placed to hold the glass tubing 122 firmly in place and prevent it from being damaged by the trough unit 119. Transition portions 122*a* of the glass tubing 122 are shown protruding out of the top of a tubing aperture 184 in the top part of the rigid faced portion 114. Also depicted in this figure is the flap element 170 and its relationship to the tongue element 172. The flap element 170 and the tongue element 172 are the means that connect the face portion 114 with the back portion 116, forming the entire support housing 112.

Figure 18:
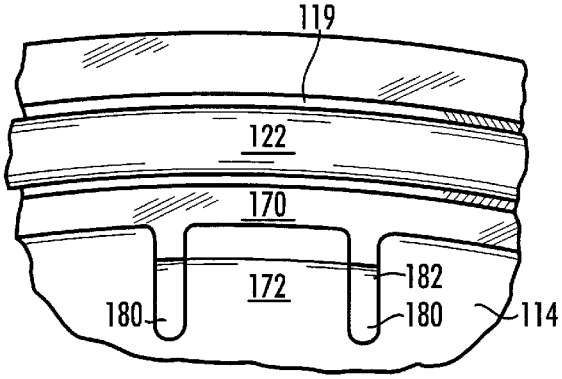
FIG. 18 is a broken-away partial view of the connecting means.
Figure 20:
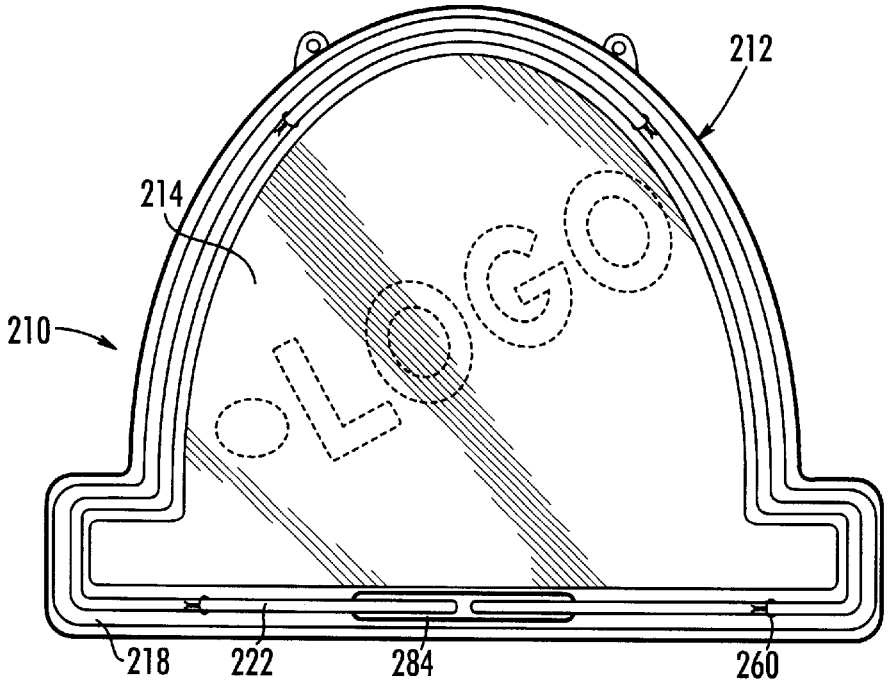
FIG. 20 is a front elevation of a fourth embodiment of the electric luminous display unit.
Figure 22:
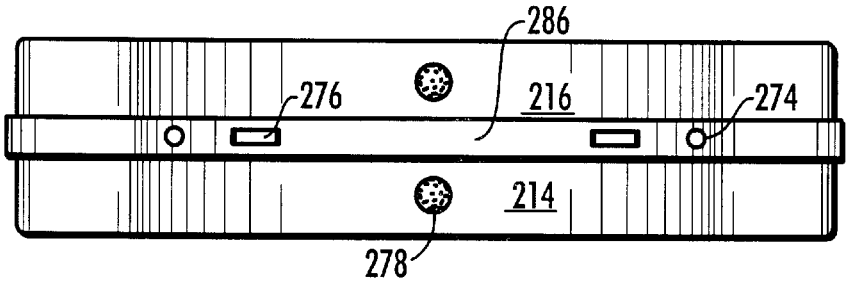
FIG. 22 is a top plan view of the fourth embodiment.
Figure 23:
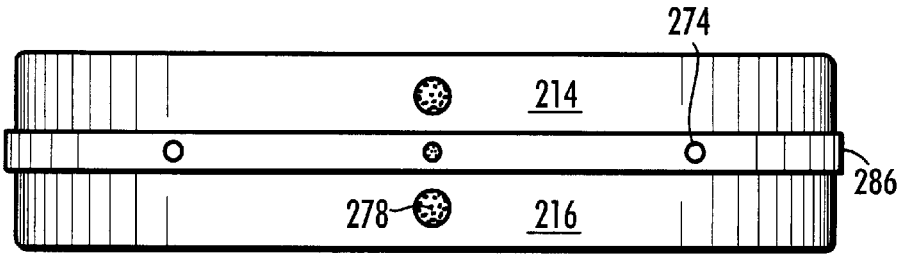
FIG. 23 is a bottom plan view of the fourth embodiment.
Figure 27:
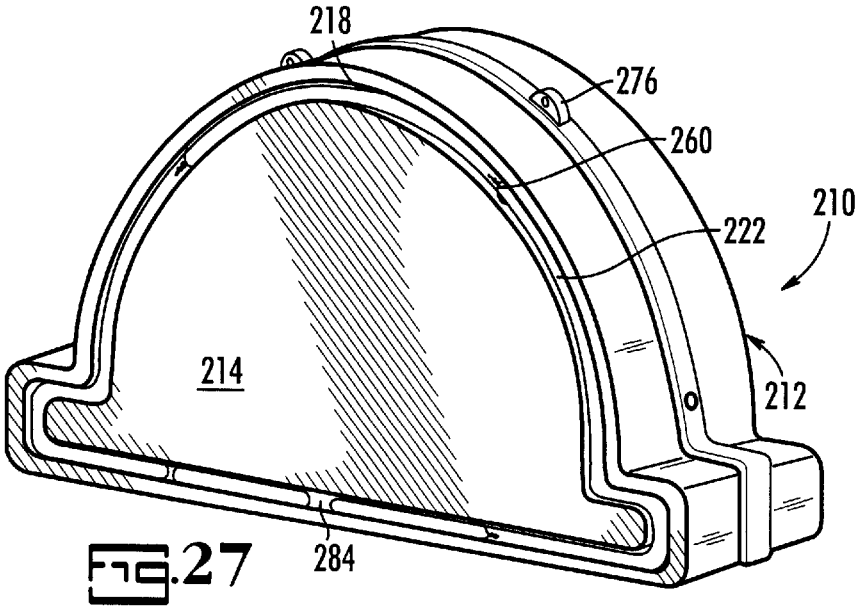
FIG. 27 is a front perspective view of the fourth embodiment of the electric luminous display unit.
Figure 21:
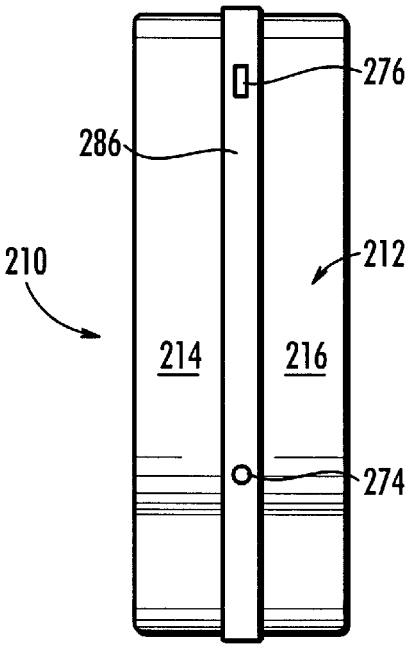
FIG. 21 is a side elevation view thereof, the opposite side being a mirror image.

FIG. 18 shows a broken-away partial view of the connection between the flap portion 170 and the tongue portion 172 as previously described. The inner edge of the trough portion 119, within which is held the glass tubing 122, forms the flap region 170 which overlaps with the tongue region 172 of the face portion 114. In the face portion 114, slots 180 are cut out forming the tongue portion 172. In the inner portion of the trough 119 which forms the flap 170, an aperture or apertures 182 are cut within the flap portion 170 to form an opening within which the tongue 172 is slid into forming, a tight friction formed connection means thereby connecting base portion 114 with the back portion 116.

Figure 19:
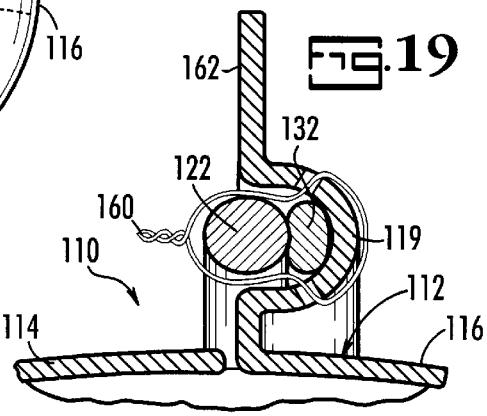
FIG. 19 is a cross-sectional view of the top portion of the electric luminous display unit.

FIG. 19 is a cross-sectional view of the top portion of the electric luminous display unit 110. In this figure the relationship between the front face portion 114 and the back portion 116 is more clearly depicted. Both the face portion 114 and the back portion 116 are preferably comprised as a thermoformable material. The back portion 116 extends up into the trough portion 119, the trough portion 119 extends up into the hanger portion 162, and the hanger portion 162 is attached the chain 166 for hanging the entire electric luminous display unit 110. The glass tubing 122 is inset in the trough 119. The glass tubing 122 is held within the trough 119 by the retention wire 160. Located between the glass tubing 122 and the trough 119 is placed a bushing 132 to help hold the glass tubing 132 securely in place within the trough 119 and also to prevent it from moving and damage. As shown in this figure, the back portion 119, the trough 119 and the hanger portion 162 are all integrally formed and comprised of one continuous piece of thermoformable material. The trough 119 extends outside an exterior to the support housing 112. This allows the glass tubing 122 to be visible from any angle when the electric luminous display unit 110 is viewed.

FIGS. 20, 21, 22 and 23 disclose the fourth embodiment of the electric luminous display unit 210. This fourth embodiment differs from the previous embodiments in that the glass tubing 222 is inlaid within groove 218 both on the face portion 214 as well as the rear portion 216 of the electric luminous display unit 210. The electric luminous display unit 210 again is comprised of a face portion 214 and a rear portion 216 of an overall support housing 212. The glass tubing 222 is retained within groove 218 by retention wire 260. The face portion 214 and the rear portion 216 of the support housing 212 are two separate pieces that are connected together along rim 286 that runs the perimeter of both the face portion 114 and the back portion 116, with the face portion rim (not shown) being placed inside the back portion rim 286 and connected together with connecting means 274. These connecting means can be any conventional type of connecting means such as screws, staples, bolts and the like. This fourth embodiment of the electric luminous display unit 210 can also be hung using hanging means 276. Located in both the top and the bottom of the support housing 212 and on both the face portion 214 and the rear portion 216 are located air vents 278. These vents allow the air within the support housing 212 to enter and escape thus prevent the electric luminous display unit 210 from overheating.

Figure 24:
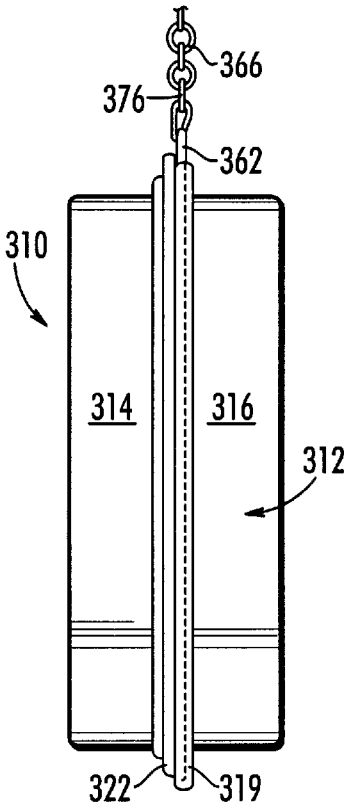
FIG. 24 is a side elevation view of a fifth embodiment of the electric luminous display unit.
Figure 28:
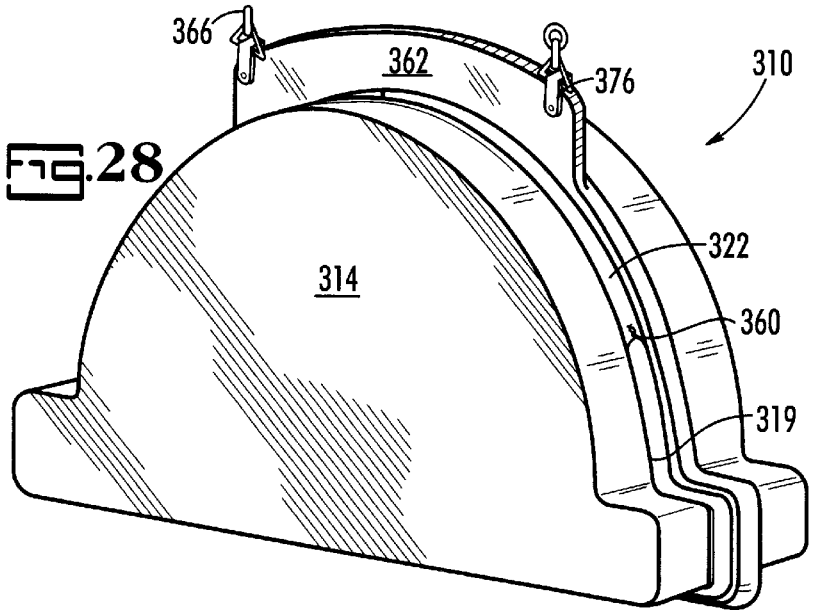
FIG. 28 is a front perspective view of the fifth embodiment of the electric luminous display unit.
Figure 25:
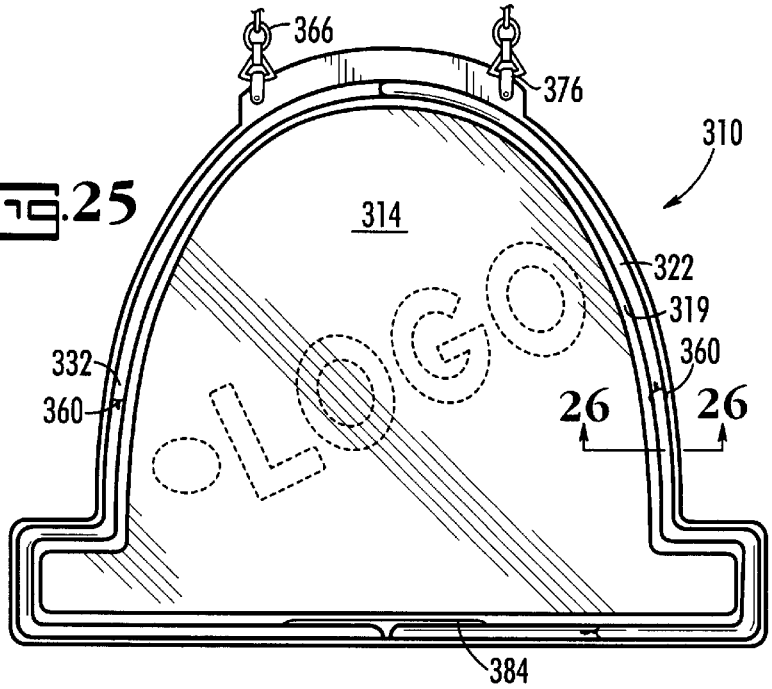
FIG. 25 is a front elevation view of the fifth embodiment thereof.
Figure 26:
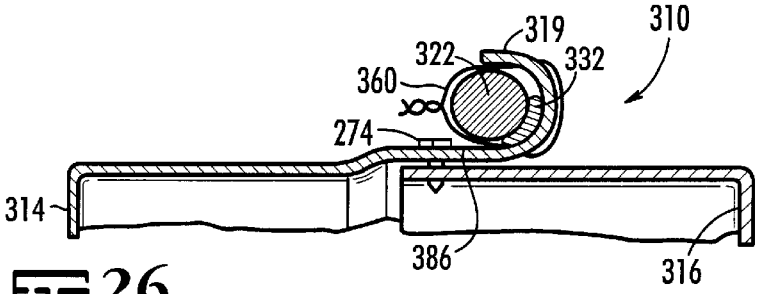
FIG. 26 is a cross-sectional view of the side of the electric luminous display unit taken along line IV—IV in FIG. 25.

FIGS. 24 and 25 both depict a fifth embodiment of the electric luminous display unit 310. This fifth embodiment is similar to the third and fourth embodiments with the support housing 312 being comprised of a thermoformable material having two separate portions, one being the rigid face portion 314 and the other being the back portion 316. This embodiment also has a hanger portion 362 which has some type of conventional hanging means such as a chain 366 connected thereto with a connecting means 376. Around the perimeter of the support housing 312 is a trough 319 within which is housed a glass tubing 322. The glass tubing is retained within the trough 319 by retention wires 360 and placed between the glass tubing 322 and the trough portion 319 are bushing elements 332 which help to hold the glass tubing 322 in place and prevent it from damage from the trough portion 319. The face portion 314 is connected to the rear portion 316 in the same manner or similar manner as in the fourth embodiment, that is, the rim (not shown) of the perimeter of the face portion 314 is inserted within the rim 386 of the back portion 316 and connected together with conventional connection means 274 such as screws, bolts, staples and the like. The difference between the fourth and the fifth embodiment is that in the fifth embodiment, the rim 386 of the rear portion 316 continues on and is integrally formed with the trough 319 which holds glass tubing 322.

Figure 29:
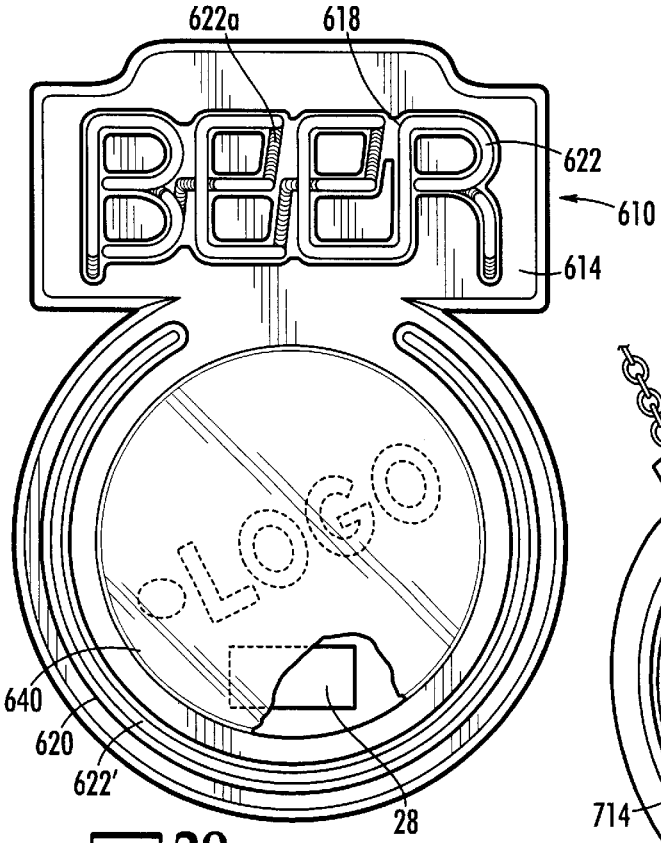
FIG. 29 is a front perspective view of a sixth embodiment of the electric luminous display unit.

A sixth embodiment of the current invention is shown in FIG. 29. In this embodiment, there is a face portion 614 made preferably of thermoformable material such as a plastic. A back portion (not shown in this figure) may take either of two forms. It may be a relatively simple casing forming the back of the unit such as is illustrated at 16 in FIG. 8, such that the unit forms a one-sided sign. Alternatively, the back portion may resemble face portion 614 as described below, such that the unit forms a two-sided sign.

In the embodiment illustrated in FIG. 29, face portion 614 is opaque and is formed with elongate grooves 618 and 620. Face portion 614 is generally formed to present a flat planar viewing surface, and grooves 618 and 620 are recessed therefrom. Gas filled tubing 622 is mounted within groove 618, and gas filled tubing 622' is shown mounted in groove 620. In each instance, grooves 618, 620 are recessed inwardly to receive and support the tubing. The grooves are formed in a shape complementary to the shape of the tubing, and are dimensioned such that the tubing lies entirely within the grooves. This dimensioning of the grooves serves two purposes. First, because the tubing is contained entirely within the grooves and does not extend or protrude therefrom, the tubing is protected from damage through contact with the unit. The tubing is also generally protected from accumulating dust or debris by virtue of being within the grooves. Secondly, having the tubing entirely within the grooves provides a visually clear and striking sign. The light produced by the tubing is directed outwardly only, and there is no visual diffusion of the light. This aids in making the tubing more visible, e.g., in low-light conditions, and more distinct. Portions 622*a* of tubing 622 and/or 622' are either opaque as formed or are covered with an opaque material such that the remaining portions of the tubing form a desired shape, and further enhances the clarity and distinctiveness of the design of the non-opaque portions of the tubing.

The tubing 622 in groove 618 may be shaped to form one or more words, a logo, or other design. The contrast between the opaque face portion 614 and the lighted tubing 622 makes the word or logo highly visible and highly legible and distinct. As mentioned above, because tubing 622 is contained entirely within groove 618, light is transmitted outwardly in a defined path, adding to the clarity of the design or word.

Groove 620 and tubing 622' are formed to substantially encompass an interior portion 640 of face portion 614. In this form, the light from tubing 622' tends to attract the attention of an observer and direct it to interior portion 640. Interior portion 640 is a transparent, semi-transparent, translucent, or semi-translucent material. Interior portion 640 can have printed or formed designs thereon, such as an advertisement, logo, or other information. Interior portion 640 is detachable from face portion 614. This allows one to change the information conveyed on interior portion 640 from time to time as desired, without requiring changes to the unit 610 as a whole. Interior portion 640 can be attached to face portion 614 through any desired known means (not shown) including screws, pins, "snap-in" flange arrangements, or the like.

As described above, the embodiment of the invention shown in FIG. 29 may be either one-sided or two-sided. That is, the back portion (not shown) may take the form of a simple opaque portion fastened, as described with respect to other embodiments herein, to face portion 614. Alternatively, the back portion may also be formed with grooves and tubing and an interior portion such as interior portion 640 to form a two-sided unit. In either case, face portion 614 and a back portion will form an interior of unit 610. As is described herein with respect to other embodiments, the electrical circuitry needed to energize the gas within the tubing 622 can be housed in the interior. Additionally, glass tubing in a grid or other desired design can be held within the interior, as is known in the art, to provide interior lighting. This interior lighting will provide backlighting for the translucent or transparent interior portion 640. The visual contrast between the opaque portions of face portion 614 and the transparent or translucent portions of interior portion 640 serves to emphasize any design imprinted or formed on interior portion 640.

Figure 30:
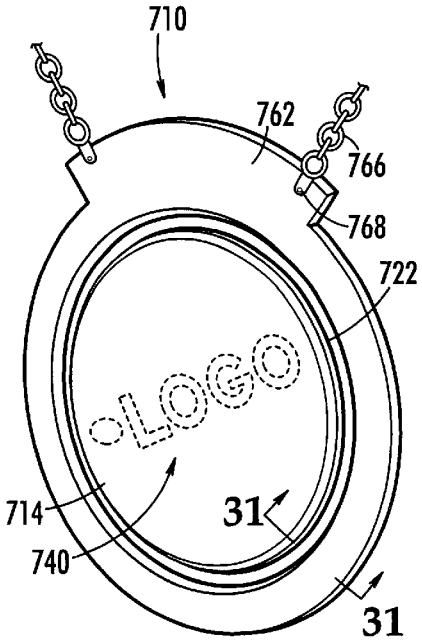
FIG. 30 is a perspective view of a seventh embodiment of the electric luminous display unit having a peripheral lip and tube.

Yet another preferred embodiment of the current invention is shown in FIG. 30. As depicted in FIG. 30, the unit 710 is a two-sided sign similar in construction to the embodiment illustrated in FIGS. 14, 15, and 16. The unit has a face portion 714 and a back portion (not shown), each of which is preferably substantially or partially transparent or translucent. Face portion 714 and the back portion are connected together as described with respect to the embodiment shown in FIG. 14 to form an interior. Within the interior are disposed electrical circuitry for powering the gas filled tubing, as described above, and a supported gridwork of gas tubing (not shown) which, when energized, provide back lighting for face portion 714 and the back portion. The face and/or back portions may have vents or holes as described above to permit dissipation of heat generated by the circuitry and/or interior gas filled tubing. Because the circuitry and interior tubing are between the face and back portions, they are protected from dust and debris. Additionally, these elements are protected from damage from accidental contact with the unit.

Either or both of face portion 714 and the back portion are provided with an interior portion 740. As depicted in FIG. 30, interior portion 740 in its preferred from is a substantially flat, planar portion. Other configurations of interior portion 740, such as a slightly rounded one, are also possible. Interior portion 740 may be an integral part of face portion 714 and formed therewith, or it may be removably attached as described with respect to interior portion 640 in FIG. 29. Interior portion 740 is intended to convey information to the observer. The information may be printed on interior portion 740 by known techniques, or a design, words, or other information may be formed on the sign through, e.g., indentations or protrusions in the material of portion 740 itself.

In the embodiment wherein interior portion 740 is removably attached to face portion 714, several advantages are realized. Interior portion 740 may be attached to face portion 714 as described above, that is, by screws, "snap-in" tabs, and similar means. In this embodiment, interior portion 740 may be removed to allow repair or maintenance of the circuitry and tubing in the interior of the unit. Also, by making interior portion 740 removable, the information conveyed by the unit may be changed as desired. When it is desired to change the information, advertisement, or other design on one interior portion 740, that portion may be removed and replaced with a portion having a different design or information.

In addition to permitting the owner of a sign to change the information conveyed by the sign by replacing the interior portion 740, this configuration also provides manufacturing advantages. A unit comprising a face portion, back portion, and the interior circuitry and tubing may be manufactured as a standard unit. Different interior portions may then be custom designed by or for individual customers. Such standardization reduces manufacturing and repair costs without limiting variations in the designs or information carried and conveyed by the units.

Figure 31:
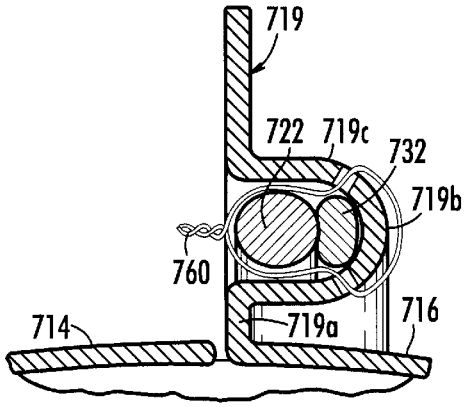
FIG. 31 is a cross-sectional view of the peripheral lip and tube of FIG. 30, taken along the line VII—VII of FIG. 30.

The embodiment 710 in FIG. 30 is also provided with at least one exterior piece of gas filled tubing around the perimeter thereof. This aspect of unit 710 is best shown in FIG. 31, which is a cross-section of unit 710 taken along the line VII—VII in FIG. 30. FIG. 31 shows a part of the edge of face portion 714 and a part of the edge of back portion 716. Extending from back portion 716 is a perimeter lip 719, preferably extending around the entire periphery of back portion 716. Perimeter lip 719, preferably transparent, extends slightly outwardly from back portion 716, as shown at 719*a*. The material of the lip 719 is curved to form a perimeter trough 719*b* and then continues outwardly as illustrated at 719*c*. Carried within the trough 719*b* is gas filled tubing 722. Gas filled tubing 722 also extends substantially entirely around the perimeter of unit 710 and, as described above, is connected to the electrical circuitry (not shown) in the interior of the unit. Tubing 722 is retained within perimeter trough 719*b* by known means such as wires 760, or clips or other retaining means. Bushings 732 can be provided between tubing 722 and trough 719*b* to protect tubing 722.

As is described with respect to other embodiments discussed above, perimeter lip 719 can be formed with a hanger portion 762. Hanger portion 762 can be provided with chains 766 for hanging the unit 710. Hanger portion 762 can also be imprinted or formed with words or a design to convey information or form an advertisement.

Because the face and back portions of the embodiment shown in FIGS. 30 and 31 are essentially symmetric, it is immaterial whether perimeter lip 719 is formed from the back or the face portion. The trough 719*b*, however, should be formed with dimensions such that the tubing 722 is entirely contained within the trough 719*b*. This helps in preventing dust and debris from accumulating on tubing 722, and additionally protects the tubing from damage from accidental contact. By making perimiter lip 719 transparent, the lip serves in part as a light guide for the light from tubing 722, creating a visually distinct, visually glowing perimeter for unit 710.

Figure 32:
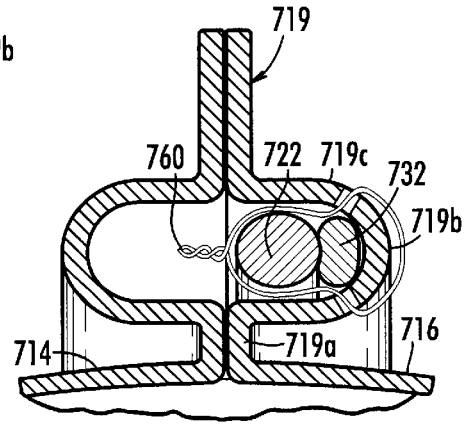
FIG. 32 is a partial cross-sectional view of a clam-shell type configuration.

Other variations, not shown, are possible for the perimeter lip of unit 710 in FIG. 30. For example, where perimeter lip 719 is formed from back portion 716, a relatively flate perimeter lip can be formed on face portion 714 such that when the unit is assembled, tubing 722 is in trough 719*b* and covered by the flat perimeter lip of face portion 71. Alternatively, both face and back portions can be provided with symmetrical perimeter lips enclosing tubing 722 in a clamshell-type configuration as shown in FIG. 32.

Thus it can be seen from the foregoing detailed description, that the current invention provides a safe, economical, luminous electrical display unit. Features such as total encapsulation of the glass tubing, for the protection of both the tubing and the public, and a translucent housing that provides an unobstructed view through the display unit, overcome many of the safety drawbacks found in prior art display units. Moreover, using a unitary piece of material for display unit housing significantly reduces manufacturing costs.

While the above description contains specificities, it is understood that many variations are apparent to one of ordinary skill in the art from a reading of the above specification. Such variations are within the spirit and scope of the current invention as defined by the following claims:

What is claimed is:

1. An electric luminous display unit for conveying visual information comprising:

a housing having a back portion and a translucent face portion;

a perimeter lip on said back portion, said perimeter lip forming a perimeter trough;

glass tubing containing inert gas positioned within said perimeter trough;

electric circuitry located between said face portion and said back portion and connected to said tubing for illumination of said tubing when said electrical circuitry is coupled to an external power source; and means for connecting said face portion with said back portion;

whereby said tubing is maintained within said trough for protection of said tubing from undesired, foreign environmental factors.

2. The electric luminous display unit according to claim 1, wherein said trough in said perimeter lip is dimensioned such that said tubing is maintained entirely within said trough.

3. The electric luminous display unit according to claim 1, wherein said glass tubing containing inert gas is positioned between said back portion and said face portion and connected to said electric circuitry whereby said internal glass tubing provides internal lighting for said unit.

4. The electric luminous display unit according to claim 1, wherein said perimeter lip is integrally formed with said back portion.

5. The electric luminous display according to claim 1, wherein said back portion, said face portion, or both further comprise a removably attached interior portion.

6. The electric luminous display unit according to claim 1, further comprising:

a flat perimeter lip on said face portion, positioned such that when said back portion is connected to face portion, said tubing is substantially enclosed within said trough by said face portion.

7. The electrical luminous display unit according to claim 1, wherein said tubing is maintained entirely within said trough with retaining wire; and at least one bushing is positioned between said tubing and said trough.

8. The electrical luminous display unit according to claim 1, wherein said connecting means comprises a flap and a tongue having a slot on each side thereof;

wherein said flap fits within said slots and is adjacent said tongue, forming a locking mechanism connecting said face portion with said back portion.

9. An electric luminous display unit for conveying visual information comprising:

a housing having a translucent face portion and back portion, said face portion having a substantially planar viewing surface, said surface having at least one trough formed therein;

glass tubing containing inert gas positioned between said face portion and said back portion and within said at least one trough;

electric circuitry located between said face portion and said back portion and connected to said tubing for illumination of said tubing when said electrical circuitry is coupled to an external power source; and means for connecting said face portion with said back portion;

whereby said tubing is maintained entirely within said trough.

10. The electric luminous display unit of claim 9, wherein said planar viewing surface further comprises a removably attached interior portion.

11. The electric luminous display unit according to claim 10, wherein said planar viewing surface has a second trough substantially surrounding said interior portion and a second glass tubing within said second trough, said second glass tubing operably connected to said electrical circuitry.

12. The electric luminous display unit according to claim 9, further comprising a removably attached interior portion selected from the group of materials comprising substantially translucent and substantially transparent material.

* * * * *